US005496407A

United States Patent [19]

McAleavey

[11] Patent Number: 5,496,407

[45] Date of Patent: Mar. 5, 1996

[54] SYSTEM AND METHOD FOR MONITORING AND CONTROLLING THICKNESS

[76] Inventor: Michael E. McAleavey, 559 Gettysburg Dr., San Jose, Calif. 95123

[21] Appl. No.: 376,649

[22] Filed: Jan. 20, 1995

Related U.S. Application Data

[63] Continuation of Ser. No. 49,785, Apr. 19, 1993, abandoned.

[51] Int. Cl.[6] ..... B05C 5/00

[52] U.S. Cl. ..... 118/677; 118/679; 118/712; 356/381; 427/10

[58] Field of Search ..... 118/663, 677, 118/679, 700, 712; 156/64; 250/560; 356/381, 382, 1; 427/8, 10

[56] References Cited

U.S. PATENT DOCUMENTS

| | | | |
|---|---|---|---|
| 3,671,726 | 6/1972 | Kerr | 356/381 |
| 3,801,349 | 4/1974 | Wilson et al. | 427/10 |
| 4,182,259 | 1/1980 | Garner et al. | 356/381 |
| 4,311,392 | 1/1982 | Yazaki et al. | 356/381 |
| 4,357,900 | 11/1982 | Buschor | 118/679 |
| 4,360,538 | 11/1982 | Craemer et al. | 427/8 |
| 4,408,562 | 10/1983 | DeCamp et al. | 118/677 |
| 4,525,376 | 6/1985 | Edgerton | 427/10 |
| 4,704,296 | 11/1987 | Leanna et al. | 427/9 |
| 4,773,760 | 9/1988 | Makkonen | 356/381 |
| 4,806,183 | 2/1989 | Williams | 118/679 |
| 4,852,515 | 8/1989 | Terasaka et al. | 118/663 |
| 4,893,485 | 1/1990 | Schwemmer et al. | 68/13 R |
| 4,925,751 | 5/1990 | Shackle et al. | 429/191 |
| 5,059,265 | 10/1991 | Asakura | 156/64 |
| 5,147,462 | 9/1992 | Wollam | 118/679 |
| 5,210,593 | 5/1993 | Krämer | 356/381 |
| 5,221,351 | 6/1993 | Esser et al. | 118/663 |
| 5,258,824 | 11/1993 | Carlson et al. | 356/382 |

*Primary Examiner*—Laura Collins

[57] ABSTRACT

In a system for monitoring and controlling the thickness of a laminate, an apparatus is provided to apply material for forming a material layer onto a web so that a laminate is formed. The tip of a knife and the surface of the web upon which the material is applied define a space, and the knife is movable relative to the web to vary the size of the space. The web coated with the material layer is drawn past the knife to form a desired thickness material layer. A measuring apparatus measures whether the thickness of the material layer plus the thickness of the web is equal to a predetermined value. The tip of the knife is moved relative to the web to adjust the thickness of the material layer in response to a signal from the measuring apparatus. A method of monitoring and controlling the thickness of a laminate is also described.

17 Claims, 6 Drawing Sheets

SYSTEM AND METHOD FOR MONITORING AND CONTROLLING THICKNESS

This application is a continuation of application Ser. No. 08/049,785, filed April 19, 1993, now abandoned.

BACKGROUND OF THE INVENTION

1. Field of the Invention

The present invention relates to systems and methods of monitoring and controlling thickness of laminates.

2. State of the Art

In recent years, workers in the battery art have begun to understand and recognize the advantages of so-called laminate batteries that include solid polymer electrolytes and sheet-like anodes and cathodes. The advantages of such batteries include lower battery weights than conventional batteries that employ liquid electrolytes, longer service life, and relatively high power densities. The advantages of laminate batteries also include relatively high specific energies, and the elimination of the danger associated with batteries containing spillable liquid electrolytes such as acids.

Laminate batteries using polymer electrolytes have been developed which possess good performance characteristics. For example, in U.S. Pat. No. 4,925,751, a laminate battery in which a cathode material formed from a mixture of an active cathodic material (preferably vanadium oxide $V_3O_8$ or $V_6OC_{13}$), a conductive filler material (preferably carbon particles or filaments), and an ionically conductive polymer electrolyte material is laminated on a conductive substrate material such as a nickel or copper web or sheet. A layer of polymer electrolyte material is laminated over the laminated layer of cathode material, and an anode material is applied over the laminated layer of polymer electrolyte material. The cathode material is applied on the substrate, and the electrolyte material is applied over the cathode material by conventional coating techniques such as with a doctor blade method or an extrusion method.

The cathode material layer on the substrate, generally has a thickness between 25 and 250 microns. The cathode layer thickness is largely determinative of the discharge rate of the battery. The electrolyte material layer on the cathode is applied in the form of a curable, viscous liquid and forms a layer that is generally between 5 and 50 microns thick. While it is desirable to maintain as thin a layer of electrolyte material over the cathode material as possible so that impedance of the electrolyte layer is minimized, if the surface of the cathode material layer is irregular and contains peaks and valleys, the average mean thickness of the electrolyte material layer must be increased to avoid excessively thin spots in the electrode material layer which may result in battery malfunction or failure.

Battery performance requires that the cathode layer and the electrolyte layer have constant thicknesses, with only very small tolerances being permitted. Further, construction of various battery configurations is greatly facilitated by maintaining constant thickness cathode and electrolyte material layers. It is, therefore, desirable to closely monitor and control the thickness and the smoothness of the cathode material layer and the thickness of the electrolyte material layer.

SUMMARY OF THE INVENTION

The present invention, generally speaking, provides a system and method for monitoring and controlling the thickness of laminates.

In accordance with one aspect of the present invention, a system for monitoring and controlling thickness of a laminate is provided. The apparatus includes means for applying material on a web. Means, disposed at a distance from the web, are provided for contacting the material applied on the web such that it forms a material layer, the material layer and the web forming a laminate. Means for measuring whether the thickness of the laminate is constant are provided. Means, responsive to the measuring means, are provided for adjusting the thickness of the material layer formed on the web.

In accordance with a further aspect of the invention, the thickness adjusting means includes means for varying the amount of material forming the material layer applied on the web.

In accordance with yet another aspect of the invention, the thickness adjusting means includes means for varying the distance between the contacting means and the web.

In accordance with a still further aspect of the present invention, the contacting means includes a knife and the thickness adjusting means includes means for moving the knife relative to the web to adjust the thickness of the material layer on the web.

In accordance with a further aspect of the present invention, the measuring means includes means for detecting a value corresponding to the thickness of the laminate and means for comparing the detected value with a predetermined value. The comparing means include means for indicating to the thickness adjusting means that the detected value is greater than, less than, or equal to the predetermined value.

In accordance with still further aspect of the present invention, the detecting means includes first means for emitting a first light beam such that the first light beam is reflected by a top side of the laminate and first means for detecting and indicating a first distance measured from the first light beam emitting means to a position to which the first light beam is reflected. The detecting means also includes second means for emitting a second light beam such that the second light beam is reflected by a bottom side of the laminate and second means for detecting and indicating a second distance measured from the second light beam emitting means to a position to which the second light beam is reflected. The detecting means also includes means for adding the first and second distances indicated by the first and second detecting and indicating means to obtain the detected value corresponding to the thickness of the laminate.

In accordance with another aspect of the present invention, a method of monitoring and controlling the thickness of a laminate is described. In the method, material is applied on a web. The material applied on the web is contacted with means disposed at a distance from the web such that it forms a material layer, the material layer and the web forming a laminate. Whether the thickness of the laminate is constant is measured. The thickness of the material layer formed on the web is adjusted in response to a signal from the measuring means.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENT

Figure 1:
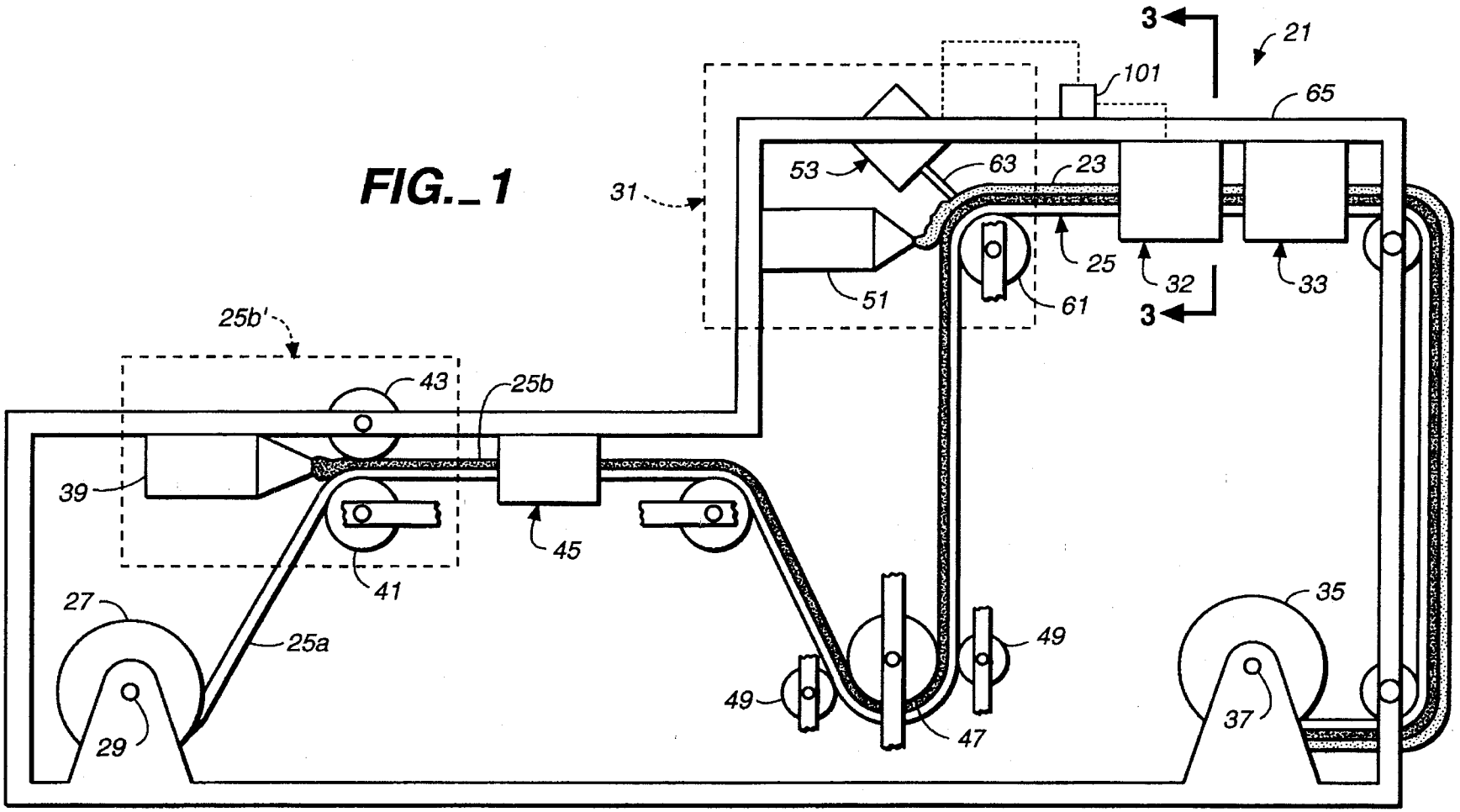
FIG. 1 is a schematic side view of a system for laminate thickness monitoring and controlling according to an embodiment of the present invention.

With reference to FIG. 1, a system 21 for monitoring and controlling the thickness of a laminate formed by a layer of material 23 on a web 25 is shown. The material forming the layer 23 is preferably a material suitable for use as an electrolyte of a battery, and the electrolyte material forms an electrolyte layer. The material for forming the electrolyte layer 23 is preferably a curable, "self-leveling" material. The material for forming the electrolyte layer is self-leveling in the sense that its viscosity, prior to being cured, is low enough that it will flow to fill peaks and valleys formed on a surface onto which it is coated. The web 25 is preferably formed of a substrate material **25*a*, such as a continuous nickel or copper web, coated with a layer of material suitable for use as an electrode of a battery, preferably material for forming a cathode material layer 25*b***. U.S. Pat. No. 4,925,751 describes materials suitable for use as cathode materials, anode materials, electrolyte materials, and substrate materials and is incorporated by reference to the extent that it describes such materials.

The web 25 is formed with as substantially uniform a thickness as possible. In accordance with the presently preferred embodiment, substrate material **25*a* for forming the web 25 is fed from a roll 27 on a shaft 29. The shaft 29 is driven by a variable speed electric motor (not shown) such that the substrate material 25*a* is fed at a substantially constant rate. After the substrate material 25*a* is coated with the cathode material layer 25*b* by means 25*b*' for applying the cathode material layer, the electrolyte material layer 23 is coated over the web 25 by means 31 for applying the electrolyte material layer. The web 25 coated with the layer of electrolyte material 23 is then drawn through means 32 for monitoring the thickness of the web coated with electrolyte material. The electrolyte material applying means 31 is responsive to signals from the thickness monitoring means 32 so that a thicker or a thinner electrolyte material layer can be formed. Together, the electrolyte material applying means 31 and the thickness monitoring means 32 make up means for monitoring and controlling the thickness of the electrolyte material layer 23**.

The electrolyte material layer 23 and the cathode material layer **25*b* are preferably cured together in a curing apparatus 33, and the web 25 coated with the electrolyte material layer 23 is rewound into a roll 35 mounted on a second shaft 37. The shaft 37 is also driven by a variable speed electric motor (not shown) so that the web 25 coated with the electrolyte material layer 23 is rewound at a substantially constant rate. The substrate material 25*a* is preferably maintained under sufficient tension between the rolls 27, 35 to minimize fluctuations in the web. Tension in the substrate material 25*a*** is preferably between 1–4 lbs/inch width.

The cathode material layer **25*b* is coated on the substrate material 25*a* by cathode material applying means 25*b*' including an extruder 39. The material for forming the cathode material layer 25*b* is preferably a paste-like, curable cathode material including vanadium oxide ($V_6O_{13}$, preferably, or $V_3O_8$). The extruder 39 preferably extrudes material for forming the cathode material layer 25*b* onto the substrate material 25*a*** in the form of a sheet; however, the extruder may extrude the material for forming the cathode material layer in the form of a bead.

The web 25 including the substrate material **25*a* and the cathode material 25*b* is kept as close to uniform thickness as possible. In accordance with the presently preferred embodiment, the extruded cathode material layer 25*b* on the substrate material 25*a* is compressed between first and second rollers 41, 43. The rollers 41, 43 evenly distribute the cathode material layer 25*b* over the substrate material 25*a*. A system 45 such as the apparatus described in U.S. patent application Ser. No. 08/049,489, filed Apr. 19, 1993, which is incorporated herein by reference, for monitoring and controlling thickness of a laminate to obtain a constant thickness web 25 is preferably provided after the rollers 41, 43** to maintain a substantially constant thickness web.

After the cathode material layer **25*b* is applied on the substrate material 25*a*, the web 25 is preferably further processed to further smooth the exposed surface of the cathode material layer, such as by compressing the cathode material layer and the substrate material between additional smoothing rollers 47, 49. When the surface of the cathode material layer 25*b* is sufficiently smooth, material for forming the electrolyte layer 23 is extruded onto the surface of the electrolyte layer by the means 31** for applying electrolyte material.

In a presently preferred embodiment, a continuous plastic sheet (not shown), preferably Tefzel™ (fluoroplastic), manufactured by DuPont, is wound around the second roller 43 and is compressed against the cathode material layer **25*b* to prevent cathode material forming the cathode material layer from sticking to the first roller 41 and the second roller and to further facilitate forming a highly smooth cathode material layer. The plastic sheet is assumed, for purposes of this discussion, to have a uniform thickness. The plastic sheet preferably remains in contact with the cathode material layer 25*b* from the nip between the first and second rollers 41, 43 until after the substrate material 25*a* and the cathode material layer have been drawn past the smoothing roller 47, 49**.

Figure 2:
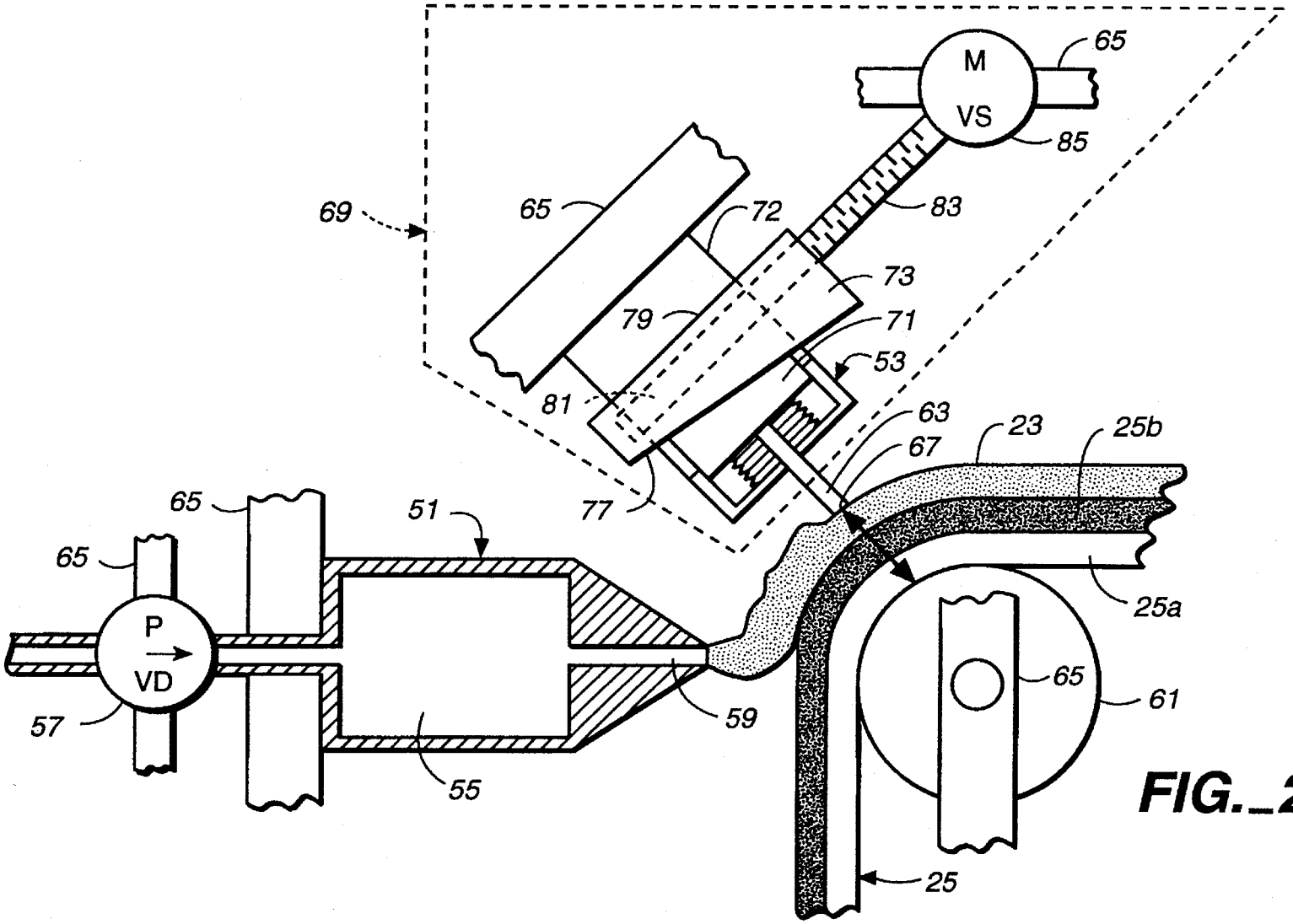
FIG. 2 is a schematic view of a portion of the apparatus of FIG. 1.

As shown in FIG. 2, the electrolyte layer applying means 31 preferably includes a doctor blade assembly including an electrolyte material extruder apparatus 51 and a movable knife assembly 53. The extruder apparatus 51 includes a reservoir or source of electrolyte material 55, and means 57 for forcing electrolyte material from the reservoir or source and through an orifice 59 of the apparatus at a particular, desired flow rate, such as a variable speed metering pump.

After the extruder apparatus 51 applies electrolyte material to the web 25, the web coated with electrolyte material passes by a web supporting means such as a roller 61 beneath the movable knife assembly 53. The web 25 may, however, be supported by other means such as by being supported in space by virtue of tension in the web. The movable knife assembly 53 includes a knife 63 that is movable relative to the surface of the web 25 upon which the electrolyte material is applied which, in practice, generally means that the knife is movable relative to the roller 61. The roller 61 is mounted on a frame. 65 so that a larger or smaller space S between the tip 67 of the knife 63 and the exterior of the roller can be formed. The web 25 and the electrolyte material for forming the electrolyte material layer 23 are drawn through the space S between the tip 67 of the knife 63 and the roller 61 so that the tip of the knife contacts the electrolyte material and forms the electrolyte material layer. The tip 67 of the knife 63 is movable relative to the roller 61 to form a thicker or thinner electrolyte material layer 23. The extruder apparatus 51 and the movable knife assembly 53 are preferably also mounted on the same frame 65.

Moving means 69 moves the knife 63 relative to the roller 61 such that the space S between the tip 67 the knife and the roller, or the surface of the web 25, is made larger or smaller. The moving means 69 is preferably adapted to move the knife 63 through very small distances so that slight variations in the size of the space S can be achieved to adjust the thickness of the electrolyte layer 23 on the web 25 by limiting the amount of electrolyte material that passes between the knife and the roller on the web. The pump 57 is preferably adapted to force more or less electrolyte material from the reservoir or source of electrolyte material 55 through the orifice 59 and onto the web 25 so that more or less electrolyte material is provided to form a thicker or thinner electrolyte material layer 23.

As shown in FIG. 2, the moving means 69 preferably includes a movable frame 71 for supporting the knife 63 and a cylinder 72 in which the movable frame is slidable. A wedge-shaped member 73 extends through the walls of the cylinder 72 and is movably disposed adjacent to the movable frame 71 such that, when the wedge-shaped member is moved in one direction so that a thicker portion of the wedge-shaped member is positioned adjacent the movable frame, the tip 67 of the knife 63 is moved closer to the roller 61 and the tip of the knife and the roller define a smaller space S. When the wedge-shaped member 73 is moved in another direction so that a thinner portion of the wedge-shaped member is positioned adjacent the movable frame 71, the tip 67 of the knife 63 is pulled away from the roller 61 by means 75 for withdrawing the knife, such as a compression spring between the knife or the movable frame 71 and the cylinder 72, and a larger space S is defined by the tip of the knife and the roller.

The wedge-shaped member 73 slides against a portion 77 of the movable frame 71 and an end portion 79 of the cylinder 72. The portions 77, 79 of the movable frame 71 and the cylinder 72 are preferably provided with bearings so that the wedge-shaped member 73 slides back and forth easily. The wedge-shape member 73 is provided with a threaded bore 81 which receives a threaded rod 83 that is rotated by means for rotating the threaded rod, such as an electric motor 85. The movable frame 71 is movable relative to the fixed electric motor 85. The electric motor 85 is preferably fixed to the fixed frame 65.

When the motor 85 turns the threaded rod 83 in one direction, the threaded rod is driven deeper into the threaded bore 81 so that the wedge-shaped member 73 is drawn at least partially out from between the movable and the fixed frames 71, 65, the knife 63 is pulled away from the roller 61 by the means 75 for withdrawing the knife and the tip 67 of the knife moves away from the roller such that they define a larger space S. When the motor 85 turns the threaded rod 83 in the other direction, the threaded rod retracts from the threaded bore 81, the wedge-shaped member 73 is pushed further in between the movable and the fixed frames 65, 71, and the tip 67 of the knife 63 is moved closer to the roller 61.

By selecting thread sizes for the threaded bore 81 and the threaded rod 83 that are sufficiently small, and by selecting a wedge angle θ that is sufficiently small, it is possible to adjust the size of the space S between the tip 67 of the knife 63 from the roller 61 through minute distances. A wide range of space size adjustments are possible by providing a sufficiently long wedge-shaped member 73, and a sufficiently long threaded bore 81 and threaded rod 83.

After the electrolyte layer 23 is coated on the web 25, the web and the electrolyte layer are drawn between the means 32 for monitoring thickness of the web and the electrolyte layer. A top laser beam generating device 87 and a bottom laser beam generating device 89, supported on a frame 91 which is preferably fixed to the fixed frame 65, generate top and bottom laser beams 93, 95. The top laser beam generating device 87 and the bottom laser beam generating device 89 direct the top and bottom laser beams 93, 95 from fixed points above and below the web 25 and the electrolyte layer 23.

The laser beams 93, 95 are directed at predetermined incident angles $\phi_i$ to the web 25 and the compressed electrolyte layer 23. The web 25 is, as noted above, under sufficient tension such that few fluctuations occur in the web and, therefore, the laser beams are reflected at substantially constant angles of reflection $\phi_r$. After the top and bottom laser beams 93, 95 are reflected from the top and bottom of the web 25 and electrolyte layer 23, they are then incident on top and bottom position sensitive detectors 97, 99 (PSDs) which sense the top and bottom positions, $P_{top}$ and $P_{bottom}$, on the top and bottom PSDs at which the top and bottom laser beams are incident on the top and bottom PSDs.

Figure 4:
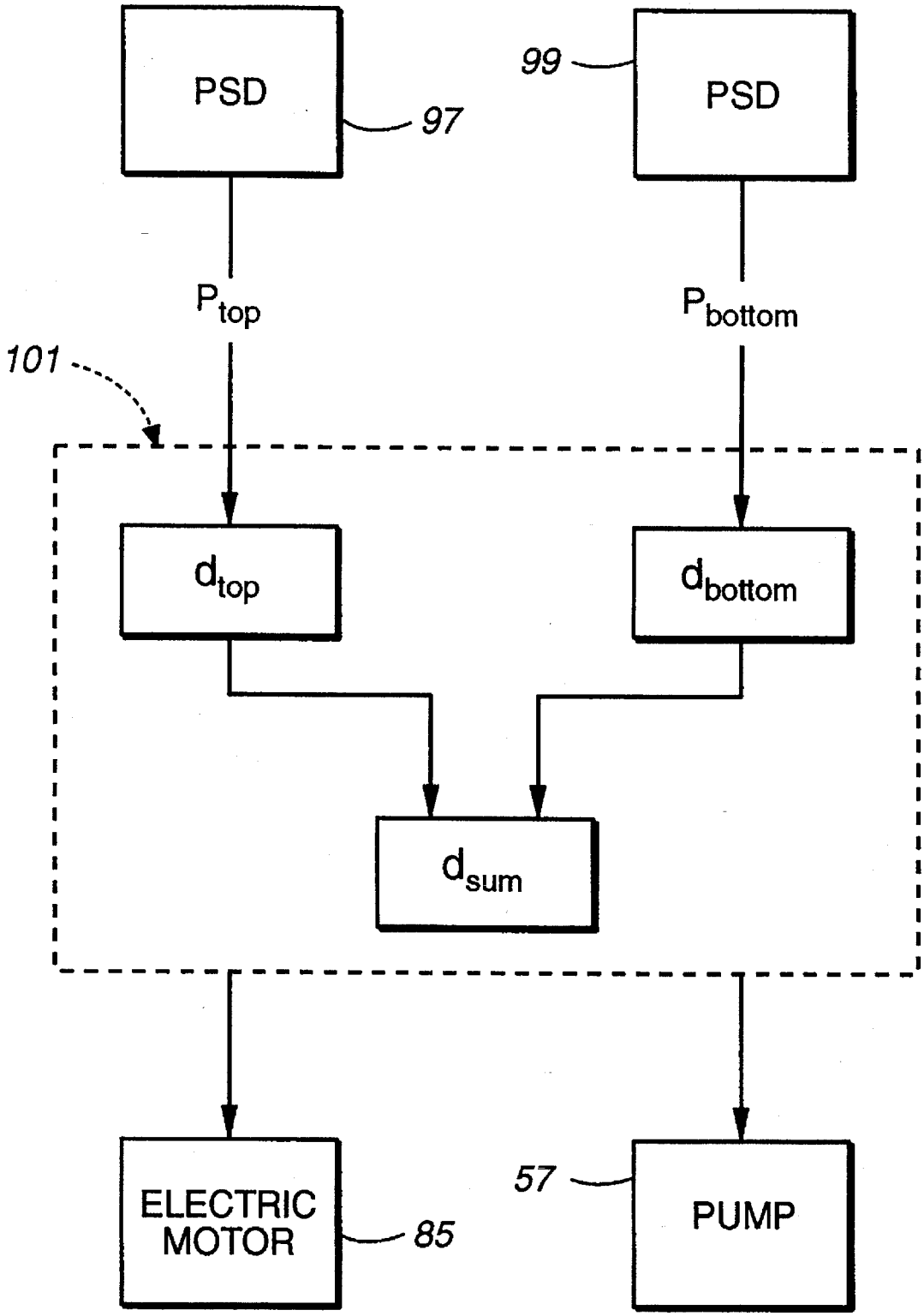
FIG. 4 is a block diagram showing the operation of elements of a system for laminate thickness monitoring and controlling according to an embodiment of the present invention.
Figure 5:
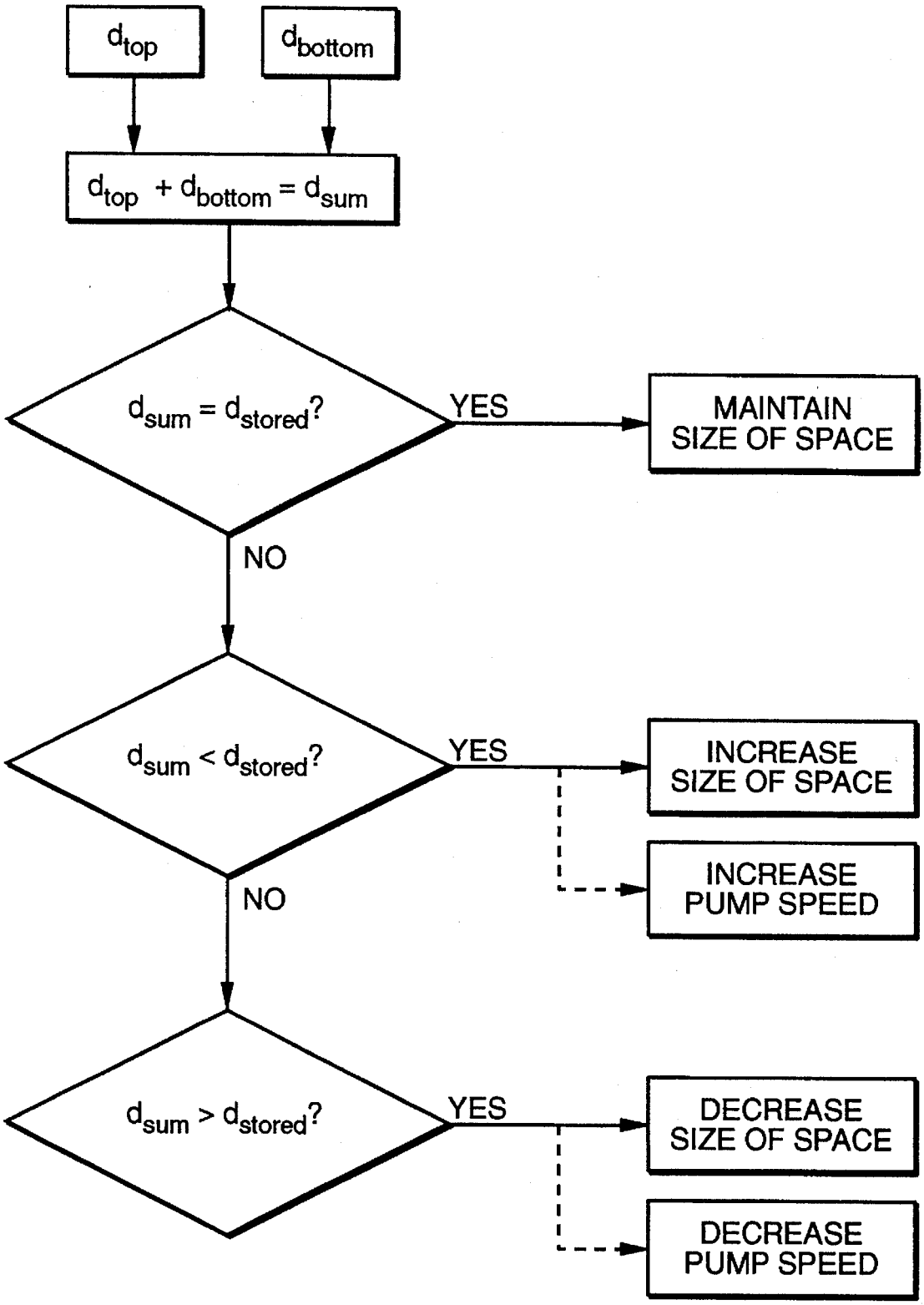
FIG. 5 is a block diagram showing a sequence of steps in the operation of a system for laminate layer thickness monitoring and controlling according to an embodiment of the present invention.

The top and bottom PSDs 97, 99 are arranged at fixed distances relative to the top and bottom laser beam generating devices 87, 89 such that, when the PSDs sense an incident laser beam at a particular position, $P_{top}$ or $P_{bottom}$, that position is at a particular distance from the laser beam generating device that generated the laser beam. Each of the top and bottom PSDs 97, 99 generates an electric signal corresponding to the top position $P_{top}$ on the top PSD 97 and the bottom position $P_{bottom}$ on the bottom PSD 99 which is transmitted to a control system means such as a microprocessor 101. As shown by the diagram of FIG. 4, the microprocessor 101 receives the transmitted signals corresponding to the top and bottom positions $P_{top}$ and $P_{bottom}$. Based on these signals, the microprocessor 101 determines the distances $d_{top}$ and $d_{bottom}$ from the top and bottom laser beam generating devices 87 and 89 to the positions $P_{top}$ and $P_{bottom}$ at which the top and bottom laser beams 93 and 95 are incident on the top and bottom PSDs 97 and 99, respectively. As shown in FIG. 5, the microprocessor 101 then adds the distances $d_{top}$ and $d_{bottom}$ to obtain a sum $d_{sum}$. The microprocessor 101 compares $d_{sum}$ to a stored value $d_{stored}$. The stored value $d_{stored}$ corresponds to the ideal sum $d_{sum}$ of the distances $d_{top}$ and $d_{bottom}$ that should prevail if the web 25 and the electrolyte layer 23 are the correct thickness. If the stored value $d_{stored}$ and the sum $d_{sum}$ are the same, then the size of the space S is not adjusted.

Figure 3A:
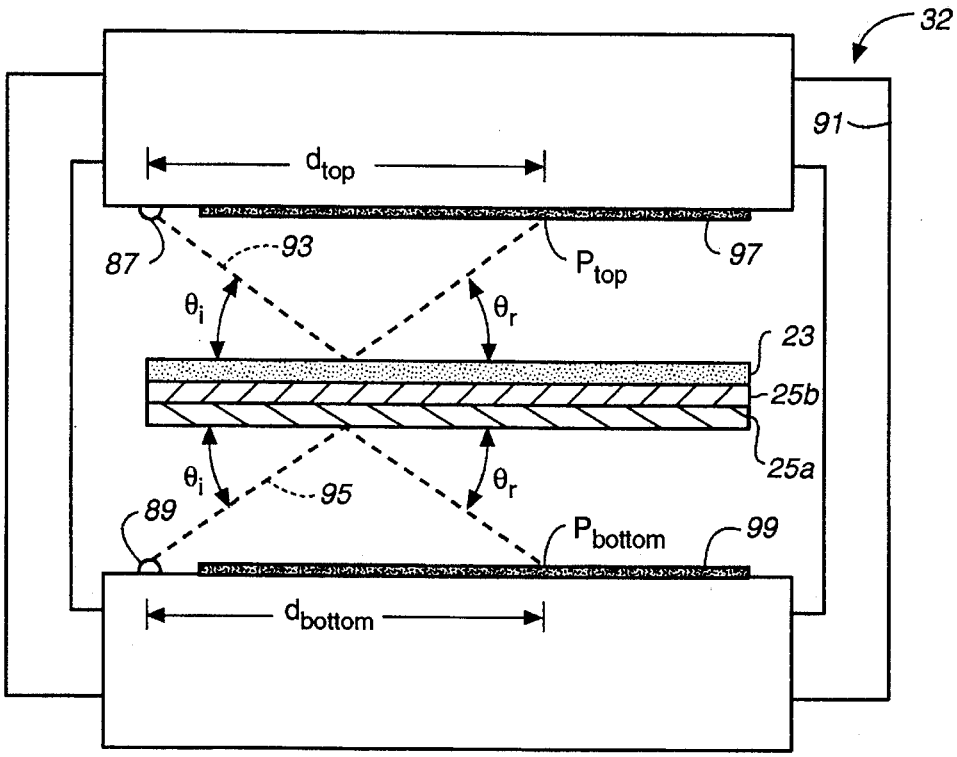
FIGS. 3A–3D are schematic views of the apparatus of FIG. 1, under differing operating conditions, taken at section 3—3.
Figure 3B:
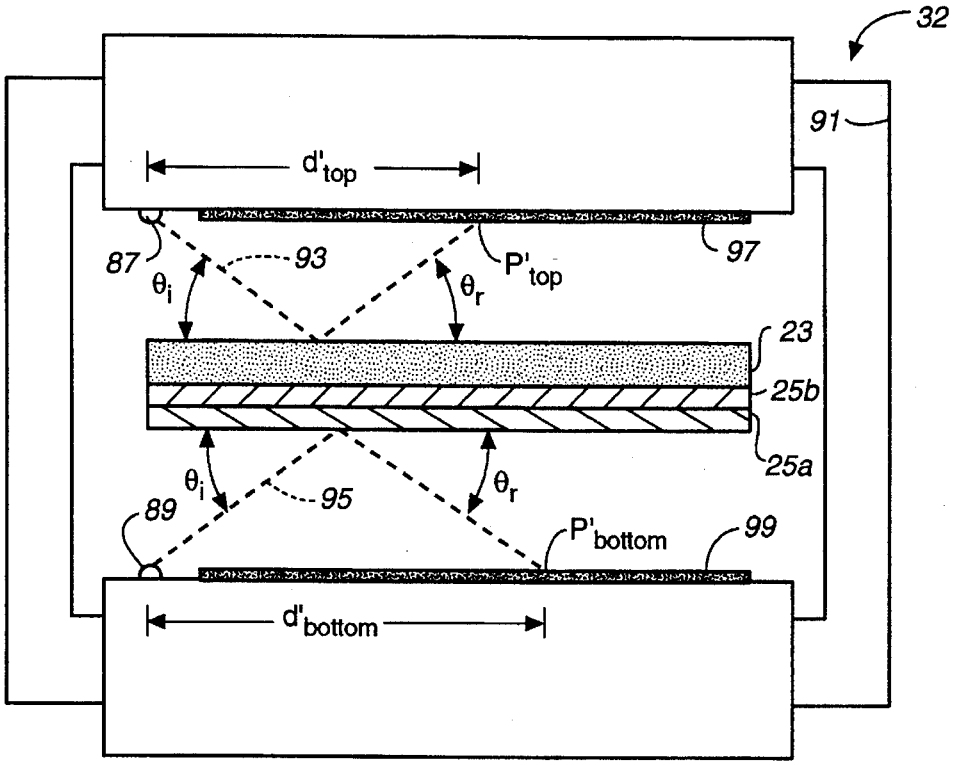

As shown in FIG. 3B, when the electrolyte material layer 23 is too thick, $d''_{top}$ and $d''_{bottom}$ equal a $d_{sum}$ that is less than $d_{stored}$. To obtain a proper thickness, the microprocessor 101 sends a signal to the electric motor 85 so that the motor turns to extract the threaded rod 83 from the threaded bore 81 in the wedge-shaped member 73. The wedge-shaped member 73 is pushed further between the movable and the fixed frame 65, 71, and the tip 67 of the knife 63 and the roller 61 define a smaller space S so that less material for forming the electrolyte layer 23 on the web 25 fits between the tip of the knife and the roller as the web and the electrolyte material are, drawn through the space S.

Figure 3C:
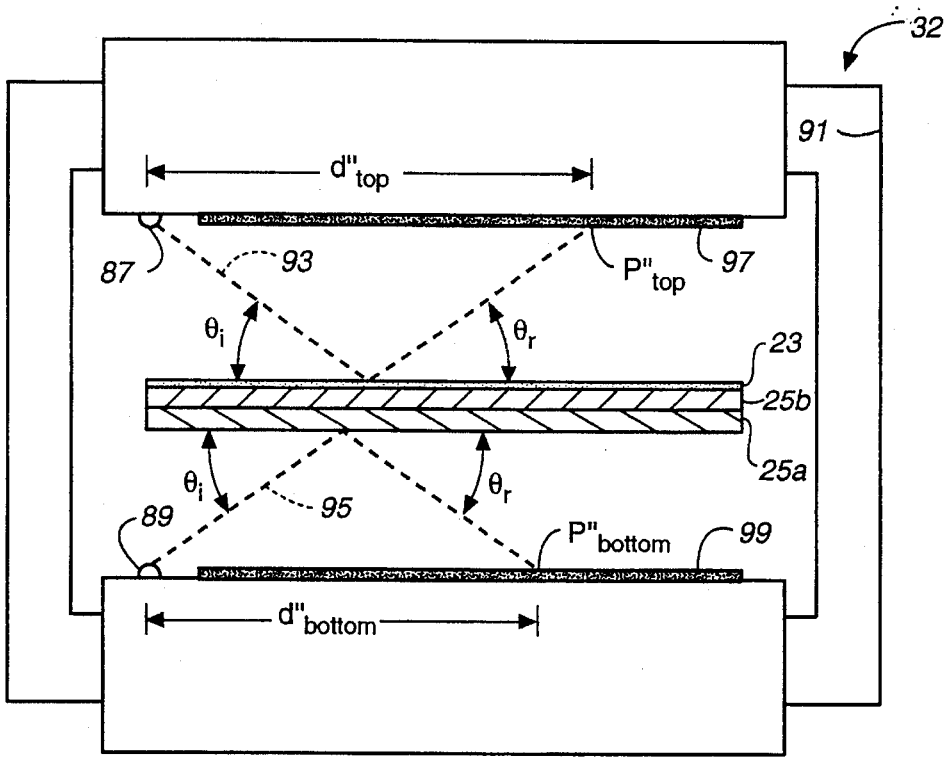

As shown in FIG. 3C, when the electrolyte material layer 23 is too thin, $d'''_{top}$ and $d'''_{bottom}$ equal a $d_{sum}$ that is greater than $d_{stored}$. To obtain a proper thickness, the microprocessor 101 sends a signal to the electric motor 85 so that the motor turns to drive the threaded rod 83 deeper into the threaded bore 81 in the wedge-shaped member 73. The wedge-shaped member is drawn from between the movable and the fixed frames 65, 71, the knife 63 is moved away from the roller 61 by the means 75 for withdrawing the knife, and the tip 67 of the knife is moved away from the roller so that more material for forming the electrolyte layer 23 on the web 25 fits through the space S defined by the tip of the knife and the roller as the web and the electrolyte material are drawn through the space. The pump 57 preferably pumps more electrolyte material from the reservoir or source 55 through the orifice 59 and onto the web 25 when the tip 67 of the knife 63 moves away from the roller 61 so that sufficient electrolyte material is provided to form the desired thickness electrolyte material layer 23. Further, the pump 57 preferably pumps less electrolyte material from the reservoir or source 55 through the orifice 59 and onto the web 25 when the tip 67 of the knife 63 moves closer to the roller 61 so that less electrolyte material is provided to form the desired thickness electrolyte material layer 23.

Figure 3D:
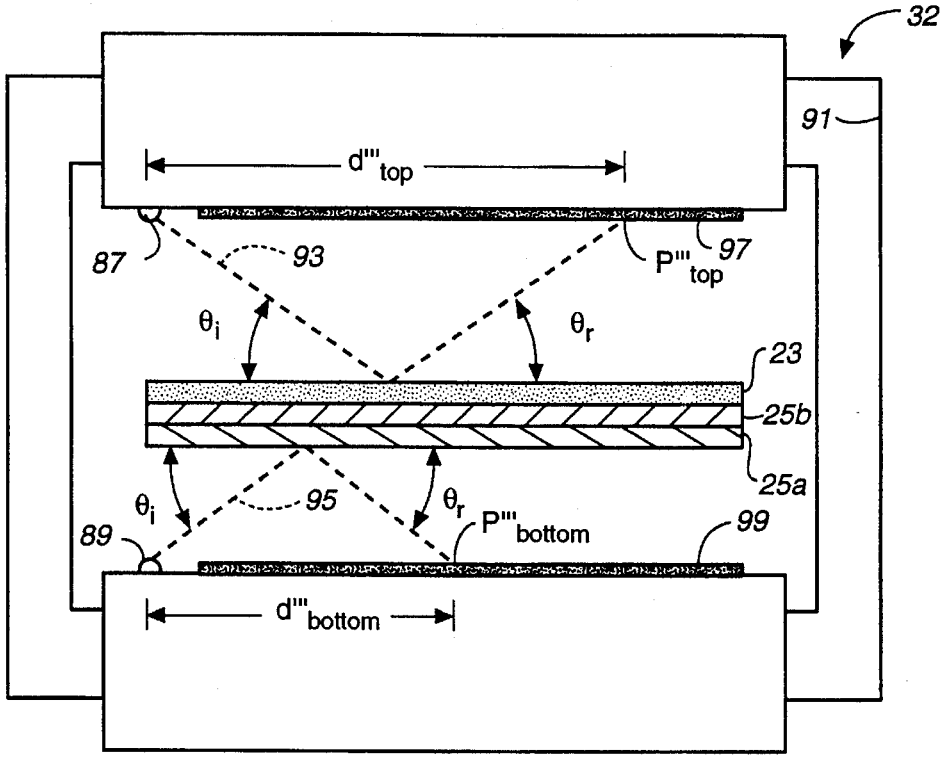

Even if the web 25 vertically fluctuates between the top and bottom laser beam generating devices 87, 89 and the top and bottom position sensitive detectors 97, 99 on the frame 91, as shown in FIG. 3D, $d_{sum}$ will be equal to $d_{stored}$ if the sum of the thicknesses of the web and the electrolyte layer 23 add up to the desired thicknesses because the method of determining $d_{sum}$ is not position sensitive. It is, nonetheless, preferred to maintain the web 25 under tension to ensure, among other things, that material for forming the electrolyte layer 23 is extruded onto the web 25 evenly.

The use of top and bottom laser beams 93, 95 permits highly accurate thickness monitoring and controlling so that the thickness of the laminate formed by the web 25 and the electrolyte material layer 23 is kept quite uniform. The arrangement including top and bottom laser beams 93, 95 has been known to detect variations as slight as 2/10 micron. Further, the constant relay of signals from the top and bottom PSDs 97, 99 to the microprocessor 101 and to the electric motor 85 described above is in so-called "real time", so that substantially as soon as laminate thickness variations occur, the system is equipped to correct for them.

The substrate material **25*a* is preferably as thin as possible, with substrate material thicknesses ranging between 5 and 50 microns, and the electrode material layer 25*b* is applied in thicknesses generally ranging between 25 and 250 microns. The thickness of the web 25 is generally substantially greater than the thickness of the electrolyte material layer 23, which generally has a thickness of approximately 5–25 microns. The apparatus and method of monitoring and controlling laminate thickness described herein does not distinguish between variations in the thickness of the laminate formed by the web 25 and the electrolyte material layer 23 that are due to variations in the thickness of the web and those that are due to variations in the thickness of the electrolyte material layer. In either instance, the apparatus and method described herein compensate for thickness variations by varying the thickness of the electrolyte material layer 23. As noted above, it is, of course, preferred that the web 25** have a thickness that is as close to constant as possible.

As noted above, after extrusion of the material for forming the electrolyte layer 23 onto the surface of the cathode material layer **25*b*, the cathode material layer and the electrolyte layer are preferably cured together in a curing apparatus such as an electron beam curing apparatus 33. However, the cathode material layer 25*b* may be cured in a separate curing apparatus (not shown) prior to extrusion of material for forming the electrolyte layer 23** onto the surface of the cathode material layer.

By keeping the thickness of the electrolyte layer 23 and the web 25 substantially constant, the self-leveling electrolyte layer 23 forms a substantially constant thickness layer when the electrolyte material is cured. A substance having an electromotive potential different from that of the electrode material on which the electrolyte material is coated (usually the cathode material layer **25*b*) is connected to the electrolyte layer 23 to form a second electrode so that ions from either the electrode material layer or the second electrode layer formed by the substance pass through the electrolyte layer to the second electrode layer or the electrode layer, respectively, and thereby form an electrochemical cell. The web 25 having the electrode material layer and the electrolyte layer 23** formed thereon is handled, such as by being folded or by being cut, and substances with electromotive potentials different from that of the electrode material layer are connected to the electrolyte layer so that batteries of desired shapes and sizes, and having desired power characteristics, are formed.

The thickness of the web 25 plus the thickness of the electrolyte layer 23 is kept substantially constant according to a method of monitoring and controlling the thickness of a electrolyte layer on the web. According to the method, cathode material is extruded onto substrate material **25*a* by the extruder 39. The extruded material and the substrate material 25*a* are compressed by the first and second rollers 49, 51 with a compressive force to form the cathode material layer 25*b*** on the substrate material.

After preferably further smoothing the cathode material layer **25*b*, the electrolyte material is applied on the cathode material layer by the electrolyte material applying means 31. The pump 57 of the electrolyte material extruder apparatus 51 pumps electrolyte material onto the web 25 from the reservoir or source of electrolyte material 55 through the orifice 59. The web 25 coated with electrolyte material is drawn past the tip 67 of the knife 63, usually as the web 25 is supported on the roller 61, so that the tip of the knife contacts the electrolyte material and forms the electrolyte material layer 23. The electrolyte layer 23 and the web 25 comprise a laminate. A value, $d_{sum}$, corresponding to the thickness of the laminate is derived by the thickness measuring means 32. The value, $d_{sum}$, corresponding to the thickness of the laminate is compared with a known value, $d_{stored}$, in the microprocessor 101**.

The thickness of the electrolyte layer 23 is adjusted so that the value, $d_{sum}$, corresponding to the laminate thickness equals the known value, $d_{stored}$. The thickness of the electrolyte layer 23 is adjusted by varying the size of the space S defined by the tip 67 of the knife 63 and the roller 61 or by pumping more electrolyte material from the reservoir or source 55 onto the web, or both. By moving the tip 67 of the knife 63 closer to the roller 61, or the surface of the web 25, less electrolyte material passes between the knife and the roller, or web, so that a thinner electrolyte material layer 23 is formed on the web. By moving the tip 67 of the knife 63 farther away from the roller 61, or the surface of the web 25, more electrolyte material passes between the knife and the roller, or web, so that a thicker electrolyte material layer 23 is formed on the web. If necessary, the pump 57 pumps more electrolyte material through the orifice 59 onto the web 25 to provide sufficient electrolyte material to form a thicker electrolyte material layer 23.

The value, $d_{sum}$, corresponding to the laminate thickness is derived by emitting the top and the bottom laser beams 93, 95 from the top and the bottom laser beam emitters 87, 89 disposed above and be low the laminate such that the top and the bottom laser beams are reflected by the top and the bottom of the laminate, as shown in FIGS. 3A–3D. The top and the bottom laser beams 93, 95 are reflected by the top and the bottom of the laminate to the top position $P_{top}$ on the top PSD 97 and the bottom position $P_{bottom}$ on a bottom PSD 99. As shown in FIG. 4, signals corresponding to the top distance $d_{top}$ from the top laser beam emitter 87 to the top position $P_{top}$ and the bottom distance $d_{bottom}$ from the bottom laser beam emitter 89 to the bottom position $P_{bottom}$ are transmitted from the top and bottom PSDs 97, 99 to the microprocessor 101 which determines the top and bottom distances. The top and bottom distances $d_{top}$ and $d_{bottom}$ are added by the microprocessor 101 to obtain the value, $d_{sum}$, corresponding to the laminate thickness. As shown in FIG. 5, the value, $d_{sum}$, corresponding to the laminate thickness is compared, in the microprocessor 101, with a known value $d_{stored}$ and, if necessary, the thickness of the electrolyte layer 23 is adjusted as described previously.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A system for monitoring and controlling thickness of a laminate, comprising:

means for applying material on a web;

contacting means, disposed at a distance from the web, for contacting the material applied on the web by the material applying means such that the material forms a material layer upon being contacted by the contacting means, wherein the material layer and the web form a laminate;

measuring means disposed downstream of said contacting means, for measuring whether the thickness of the laminate is equal to a predetermined thickness; and thickness adjusting means, in communication with said measuring means, for adjusting the thickness of the material layer formed on the web by varying at least one of the distance between the contacting means and the web and an amount of the material applied on the web by the material applying means so that the thickness of the laminate corresponds to the predetermined thickness, wherein the measuring means includes means for detecting a value corresponding to the thickness of the laminate and means for comparing a detected value with a predetermined value, the comparing means including means for indicating to the thickness adjusting means that the detected value is greater than, less than, or equal to the predetermined value, the detecting means including first means for emitting a first light beam such that the first light beam is reflected by a top side of the laminate, first means for detecting and indicating a first distance measured from the first light beam emitting means to a position to which the first light beam is reflected.

second means for emitting a second light beam such that the second light beam is reflected by a bottom side of the laminate, second means for detecting and indicating a second distance measured from the second light beam emitting means to a position to which the second light beam is reflected, and means for adding the first and second distances indicated by the first and second detecting and indicating means to obtain the detected value corresponding to the thickness of the laminate.

2. The apparatus of claim 1, wherein the contacting means includes a knife and the thickness adjusting means includes means for moving the knife relative to the web to adjust the thickness of the material layer on the web.

3. The apparatus of claim 1, wherein the comparing means includes a microprocessor.

4. The apparatus of claim 1, wherein the thickness adjusting means adjusts the thickness of the material layer to be thicker when the indicating means of the comparing means indicates that the detected value is greater than the predetermined value.

5. The apparatus of claim 1, wherein the thickness adjusting means adjusts the thickness of the material layer to be thinner when the indicating means of the comparing means indicates that the detected value is less than the predetermined value.

6. The apparatus of claim 1, wherein the thickness adjusting means keeps the thickness of the material layer constant when the indicating means of the comparing means indicates that the detected value is equal to the predetermined value.

7. The apparatus of claim 6, wherein the contacting means includes a knife and the thickness adjusting means includes means for moving the knife relative to the web to adjust the thickness of the material layer on the web.

8. The apparatus of claim 1, further comprising rigid means disposed in opposition to said contacting means for supporting the web at a point where the contacting means contacts the material on the web.

9. The apparatus of claim 8, wherein the rigid means includes a roller around which the web extends.

10. A method of monitoring and controlling the thickness of a laminate, comprising the steps of:

applying material on a web;

contacting the material applied on the web with means disposed at a distance from the web such that it forms a material layer, the material layer and the web forming a laminate;

measuring, with measuring means, whether the thickness of the laminate is constant; and adjusting the thickness of the material layer formed on the web in response to a signal from the measuring means, wherein whether the thickness of the laminate is constant is measured by detecting a value corresponding to the thickness of the laminate and comparing a detected value with a predetermined value, and the thickness of the laminate is adjusted by indicating to a thickness adjusting means that the detected value is greater than, less than, or equal to the predetermined value, the value corresponding to the thickness of the laminate being detected by emitting a first light beam from a first light beam emitting means such that the first light beam is reflected by a top side of the laminate, detecting and indicating a first distance measured from the first light beam emitting means to a position to which the first light beam is reflected, emitting a second light beam from a second light beam emitting means such that the second light beam is reflected by a bottom side of the laminate, detecting and indicating a second distance measured from the second light beam emitting means to a position to which the second light beam is reflected, and adding the first and second distances indicated by the first and second detecting and indicating means to obtain the detected value corresponding to the thickness of the laminate.

11. The method of claim 10, wherein the thickness of the laminate is adjusted by varying the amount of material forming the material layer applied on the web.

12. The method of claim 11, wherein the thickness of the laminate is further adjusted by varying the distance between the contacting means and the web.

13. The method of claim 10, wherein the thickness of the laminate is adjusted by varying the distance between the contacting means and the web.

14. The method of claim 13, wherein the contacting means includes a knife and the thickness is adjusted by moving the knife relative to the web.

15. The method of claim 10, wherein the thickness of the material layer is adjusted to be thicker when the detected value is greater than the predetermined value.

16. The method of claim 10, wherein the thickness of the material layer is adjusted to be thinner when the detected value is less than the predetermined value.

17. The method of claim 10, wherein the thickness of the material layer is kept constant when the detected value is equal to the predetermined value.

* * * * *